US010799409B2

(12) United States Patent
Rydstrom et al.

(10) Patent No.: US 10,799,409 B2
(45) Date of Patent: Oct. 13, 2020

(54) SUBJECT SUPPORT APPARATUSES

(71) Applicant: Liko Research & Development AB, Luleå (SE)

(72) Inventors: Peter Rydstrom, Gammelstad (SE); Jolanda Madia, Luleå (SE)

(73) Assignee: LIKO RESEARCH & DEVELOPMENT AB, Lulea (SE)

( * ) Notice: Subject to any disclaimer, the term of this patent is extended or adjusted under 35 U.S.C. 154(b) by 378 days.

(21) Appl. No.: 15/836,129

(22) Filed: Dec. 8, 2017

(65) Prior Publication Data

US 2018/0185226 A1 Jul. 5, 2018

Related U.S. Application Data

(60) Provisional application No. 62/440,449, filed on Dec. 30, 2016.

(51) Int. Cl.
*A61G 7/10* (2006.01)
*A61H 3/00* (2006.01)

(52) U.S. Cl.
CPC ..... *A61G 7/1051* (2013.01); *A61G 7/1015* (2013.01); *A61H 3/008* (2013.01); *A61G 7/1061* (2013.01); *A61G 2200/36* (2013.01); *A61H 2201/1652* (2013.01)

(58) Field of Classification Search
CPC ..... A61G 7/10; A61G 7/1051; A61G 7/1015; A61G 7/1061; A61G 2200/36; A61H 3/008; A61H 2201/1652
See application file for complete search history.

(56) References Cited

U.S. PATENT DOCUMENTS 2,719,568 A * 10/1955 Webb ..... A61H 3/008 482/68
3,252,704 A * 5/1966 Louise ..... A61G 7/1051 482/68
3,761,082 A * 9/1973 Barthel, Jr. ..... A61H 3/008 482/69

(Continued)

FOREIGN PATENT DOCUMENTS

DE 102007050575 A1 4/2009
DE 102014004997 A1 10/2015
KR 20010099099 A 11/2001

OTHER PUBLICATIONS

Liko R&D AB, "Secure the Lift with Our Wide Range of Lifting Accessories", Order No. 181214, rev. 1, Mar. 12, 2013, pp. 1-28.

(Continued)

*Primary Examiner* — David R Hare
(74) *Attorney, Agent, or Firm* — Dinsmore & Shohl LLP

(57) ABSTRACT

A subject support apparatus includes an upper portion including a torso panel having a first end and a second end, a loop strap having a first free end extending from the first end of the torso panel and a second free end extending from the second end of the torso panel and configured to couple the first end of the torso panel to the second end of the torso panel to form a closed loop, and a pair of shoulder straps coupled to the torso panel and extending from a top edge of the torso panel. The subject support apparatus also includes a lower portion coupled to the pair of shoulder straps and extending from a bottom edge of the torso panel. The lower portion has a seat piece having a front end and a rear end.

19 Claims, 10 Drawing Sheets

(56) References Cited

U.S. PATENT DOCUMENTS 4,922,860 A * 5/1990 Hutchings ..... A01K 27/002 294/140
5,660,445 A * 8/1997 Murray ..... A61F 5/3776 297/485
5,663,560 A 9/1997 Svendsen et al.
5,704,881 A 1/1998 Dudley
6,315,138 B1 11/2001 Dyson
6,397,389 B1 * 6/2002 Schultz ..... A47D 13/046 119/907
6,436,011 B1 * 8/2002 Cook ..... A63B 69/0064 119/770
6,752,776 B2 * 6/2004 West ..... A61H 3/008 602/32
6,892,403 B2 * 5/2005 Liljedahl ..... A61G 7/1051 5/89.1
6,910,993 B1 * 6/2005 Baran ..... A47D 13/046 434/247
7,066,181 B2 * 6/2006 West ..... A61H 3/008 128/869
D612,059 S * 3/2010 Haney ..... A62B 35/0018 D24/188
7,979,919 B2 * 7/2011 Joran ..... A62B 35/0018 2/69
7,993,248 B1 8/2011 Rasmussen
2004/0133963 A1 7/2004 Jennings
2013/0116604 A1 * 5/2013 Morilla ..... A61G 7/1015 601/33
2013/0178767 A1 * 7/2013 Dreske ..... A61H 3/008 601/23
2013/0205466 A1 * 8/2013 Arnold ..... A41D 1/00 2/83
2015/0216753 A1 8/2015 Arespong et al.
2016/0367429 A1 * 12/2016 Dolce ..... A61H 3/008

OTHER PUBLICATIONS

Woodway, "Product Information Locomotion Therapy", Rev Feb. 2004, vol. 1, pp. 1-21.
RehabHarness™, "Balance Harness", <URL: http://www.rehabharness.com/listings.php?listing=2 2>, 2017, pp. 1-8.
RehabHarness™, "Your Harness-Supported Gait and Balance Training Resource!", <URL: http://www..rehabharness.com/index.php>, pp. 1-6.
Biodex, "FreeStep SAS—Supported Ambulation System", <URL: http://www.biodex.com/physical-medicine/products/supported-ambulation/freestep-sas>, 2017, pp. 1-2.
SoloStep Inc., "Ceiling-Mounted Track System", <URL: http://solostep.com/products/ceiling-mounted-track-system/>, 2017, pp. 1-8.
Liko, "LikoLiftPants™, Mod. 92, TeddyPants™, Mod. 92", 7EN160170-03, 2010, pp. 1-4.
Liko, "Liko™ LiftPants™ sling, Mod. 92, TeddyPants, Mod. 92", 7EN160170 Rev. 4, 2015, pp. 1-4.
Liko, "Liko™ MasterVest™, Mod. 60, 64, TeddyVest, Mod. 60, 64", 7EN160168 Rev. 6, 2015, pp. 1-8.

* cited by examiner

SUBJECT SUPPORT APPARATUSES

CROSS REFERENCE TO RELATED APPLICATIONS

The present specification claims the benefit of U.S. Provisional Patent Application No. 62/440,449 filed Dec. 30, 2016 and entitled "Subject Support Apparatuses," the entirety of which is incorporated by reference herein.

BACKGROUND

Field

The present specification generally relates to subject support apparatuses, and more particularly to subject support apparatuses including an upper portion to support the torso of a subject and a lower portion to support the lower body of the subject.

Technical Background

Person lifting devices, such as mobile lifts and/or overhead lifts, may be used in hospitals, other health care facilities, and sometimes in home care settings to move a subject or assist in moving a subject from one location to another. Conventional lifting devices are coupled to a subject support apparatus that supports and engages the subject. Such conventional support apparatuses that engage only the torso of the subject may ride up on the subject causing discomfort. Moreover, conventional support apparatuses that only engage limited portions of the subject may apply force to those limited portions of the subject, which may in turn lead to discomfort.

Accordingly, a need exists for alternative subject support apparatuses that distribute forces applied to the subject.

SUMMARY

In one embodiment, a subject support apparatus includes an upper portion including a torso panel having a first end and a second end, a loop strap having a first free end extending from the first end of the torso panel and a second free end extending from the second end of the torso panel and configured to couple the first end of the torso panel to the second end of the torso panel to form a closed loop, and a pair of shoulder straps coupled to the torso panel and extending from a top edge of the torso panel. The subject support apparatus also includes a lower portion coupled to the pair of shoulder straps and extending from a bottom edge of the torso panel. The lower portion has a seat piece having a front end and a rear end.

In another embodiment, a subject support apparatus includes an upper portion including a torso panel having a first end and a second end, a loop strap having a first free end extending from the first end of the torso panel and a second free end extending from the second end of the torso panel and configured to couple the first end of the torso panel to the second end of the torso panel to form a closed loop, and a pair of shoulder straps coupled to the torso panel and extending from a top edge of the torso panel. The subject support apparatus also includes a lower portion coupled to the pair of shoulder straps and extending from a bottom edge of the torso panel. The lower portion has a seat piece having a front end and a rear end. At least a portion of one of the loop strap and the pair of shoulder straps includes an elastic material.

In yet another embodiment, a subject support system includes a subject support apparatus and a support assist device. The subject support apparatus includes an upper portion including a torso panel having a first end and a second end, a loop strap having a first free end extending from the first end of the torso panel and a second free end extending from the second end of the torso panel and configured to couple the first end of the torso panel to the second end of the torso panel to form a closed loop, and a pair of shoulder straps coupled to the torso panel and extending from a top edge of the torso panel. The subject support apparatus also includes a lower portion coupled to the pair of shoulder straps and extending from a bottom edge of the torso panel. The lower portion has a seat piece having a front end and a rear end. The support assist device includes at least one elastic strap coupled to at least one limiting strap. The support assist device is coupled to the pair of shoulder straps of the subject support apparatus and is configured to couple the subject support system to an overhead structure.

Additional features of subject support apparatuses described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
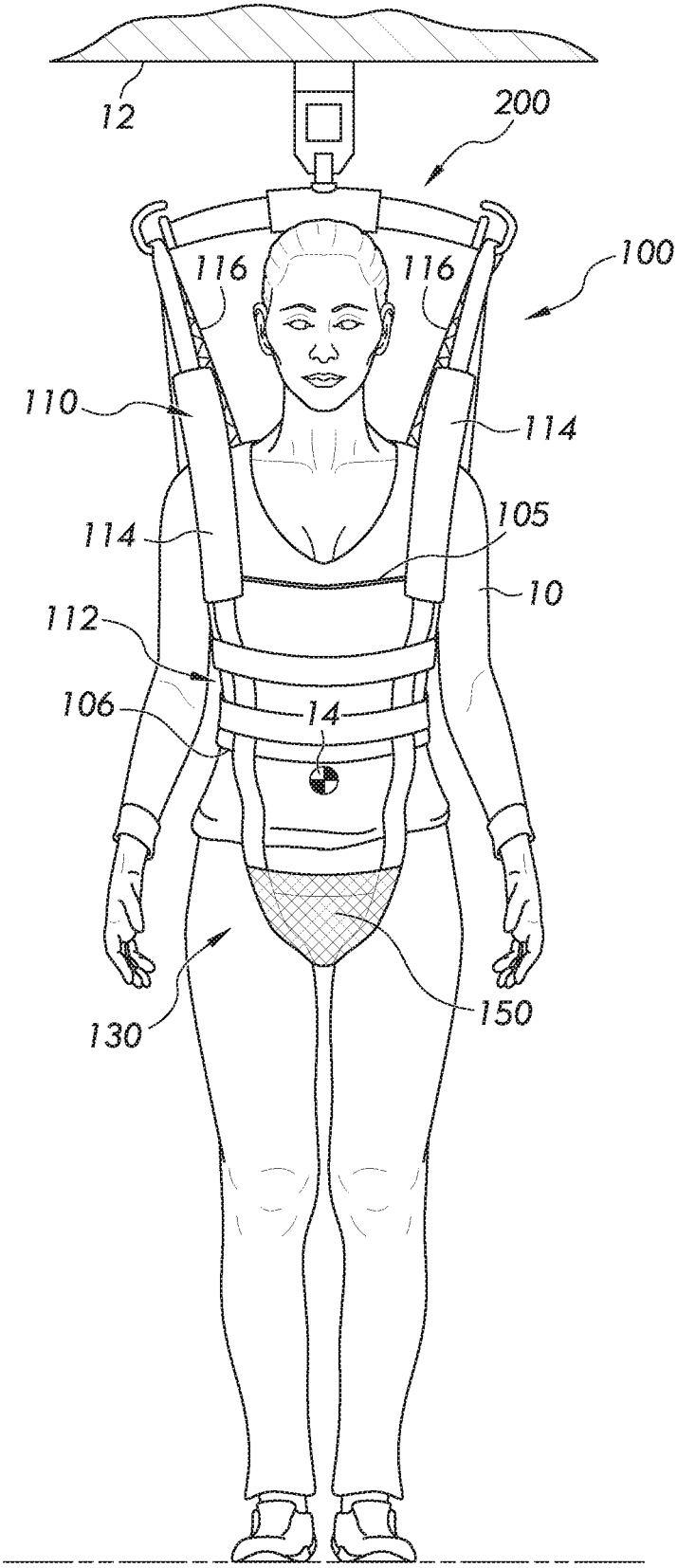
FIG. 1 schematically depicts a front view of a subject support apparatus according to one or more embodiments shown and described herein.

Reference will now be made in detail to embodiments of subject support apparatuses, examples of which are illustrated in the accompanying drawings. Whenever possible, the same reference numerals will be used throughout the drawings to refer to the same or like parts. In one embodiment, a subject support apparatus includes an upper portion including a torso panel having a first end and a second end, a loop strap having a first free end extending from the first end of the torso panel and a second free end extending from the second end of the torso panel and configured to couple the first end of the torso panel to the second end of the torso panel to form a closed loop, and a pair of shoulder straps coupled to the torso panel and extending from a top edge of the torso panel. The subject support apparatus also includes a lower portion coupled to the pair of shoulder straps and extending from a bottom edge of the torso panel. The lower portion has a seat piece having a front end and a rear end. Without being bound by theory, the use of a subject support apparatus that includes an upper portion and a lower portion coupled through the pair of shoulder straps distributes the forces applied to the subject more evenly to the body of the subject, which may reduce subject discomfort. Various embodiments of subject support apparatuses will be described herein with specific reference to the appended drawings.

Subject Support Apparatuses

Figure 2:
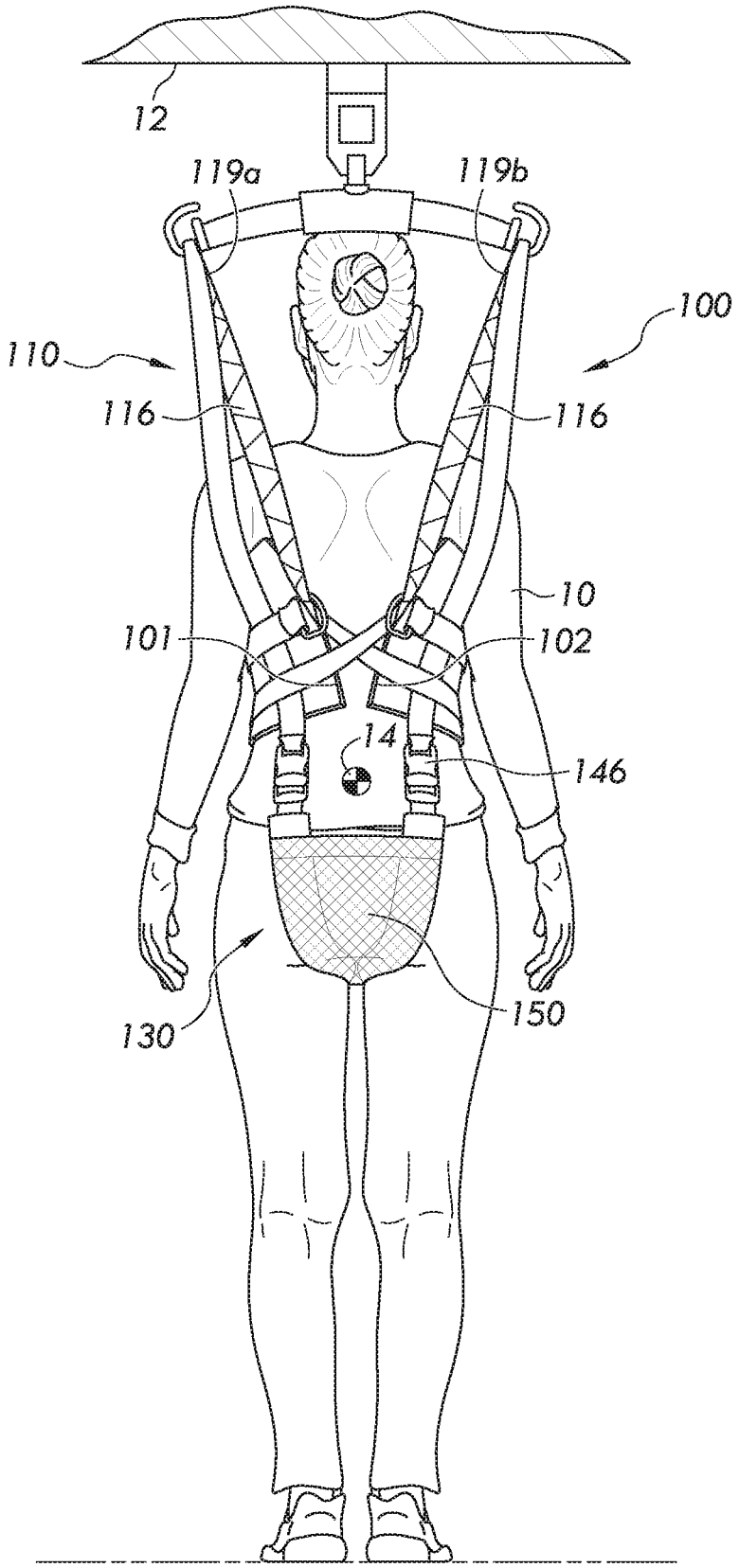
FIG. 2 schematically depicts a rear view of the subject support apparatus of FIG. 1 according to one or more embodiments shown and described herein.

Referring collectively to FIGS. 1 and 2, a subject 10 is positioned in a subject support apparatus 100. The subject support apparatus 100 includes an upper portion 110 and a lower portion 130 that is coupled to the upper portion 110. The upper portion 110 includes a torso panel 112 having a first end 101 and a second end 102 and a pair of loop straps 116 extending from the first end 101 and the second end 102 of the torso panel 112. The loop straps 116 are configured to couple the first end 101 of the torso panel 112 to the second end 102 of the torso panel 112 to form a closed loop, as will be described in detail below. The upper portion 110 also includes a pair of shoulder straps 114 that are coupled to the torso panel 112 and extend from a top edge 105 of the torso panel 112. The lower portion 130 is coupled to the pair of shoulder straps 114 and extends from a bottom edge 106 of the torso panel 112.

In the embodiment depicted in FIG. 1, the upper portion 110 and the lower portion 130 of the subject support apparatus 100 are at least partially non-releasably secured to one another through the pair of shoulder straps 114. For example, in the embodiment depicted in FIGS. 1 and 5, the lower portion 130 may extend from the bottom edge 106 of the torso panel 112 and be coupled to the pair of shoulder straps 114. The lower portion 130 may be coupled to the pair of shoulder straps 114 by stitching the shoulder straps 114 to the seat piece 150 of the lower portion 130, for example. As shown in FIG. 2, an opposing end of the seat piece 150 may be coupled to the shoulder straps 114 using buckles 146, thereby securing the lower portion 130 about the subject 10. By coupling the lower portion 130 to the upper portion 110 through the shoulder straps 114, the weight of the subject 10 may be transferred up through the subject support apparatus 100, to the overhead structure 12, thereby reducing pressure on the torso of the subject 10.

Figure 3A:
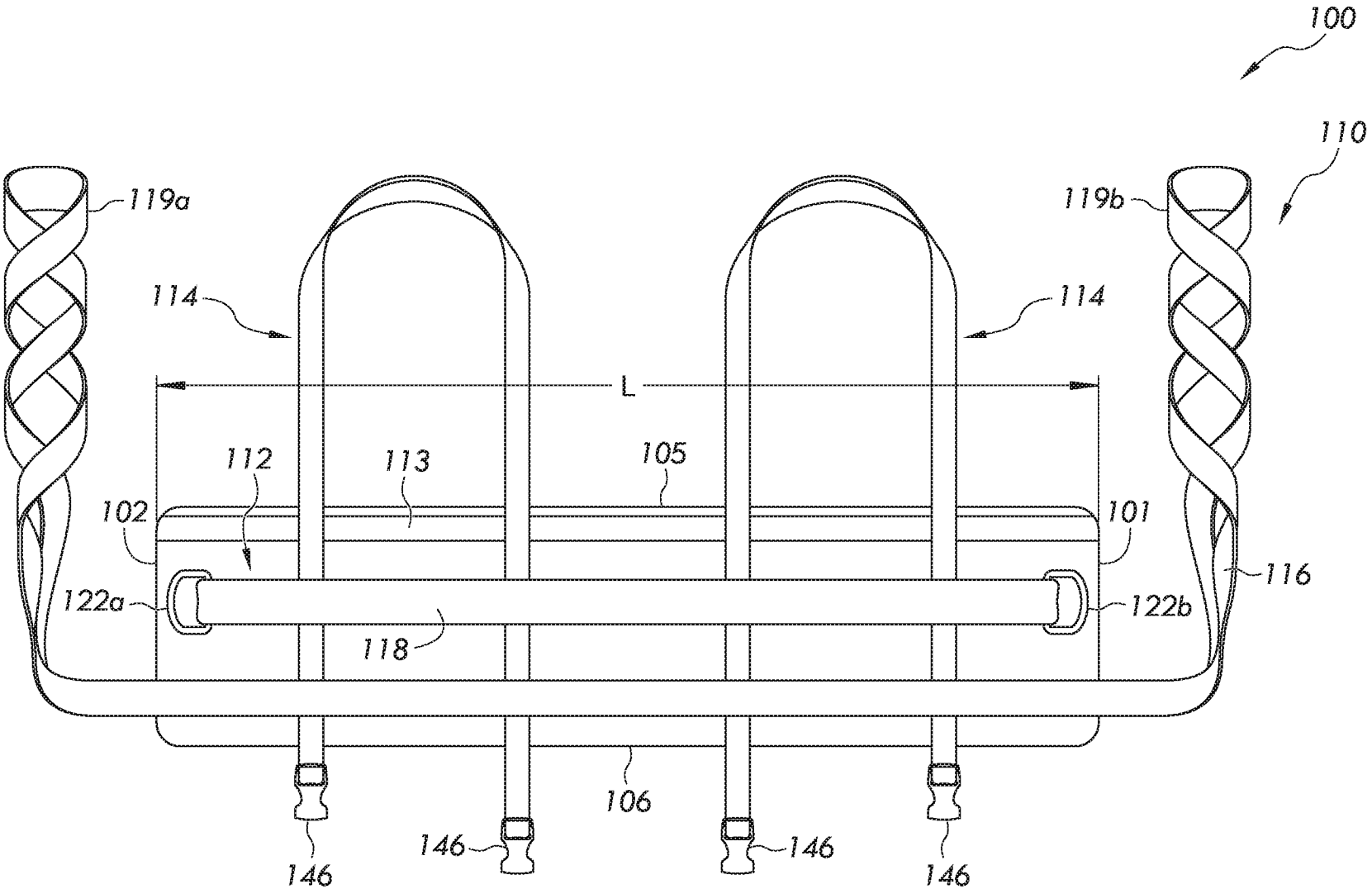
FIG. 3A schematically depicts a front view of an upper portion of a subject support apparatus according to one or more embodiments shown and described herein.
Figure 3B:
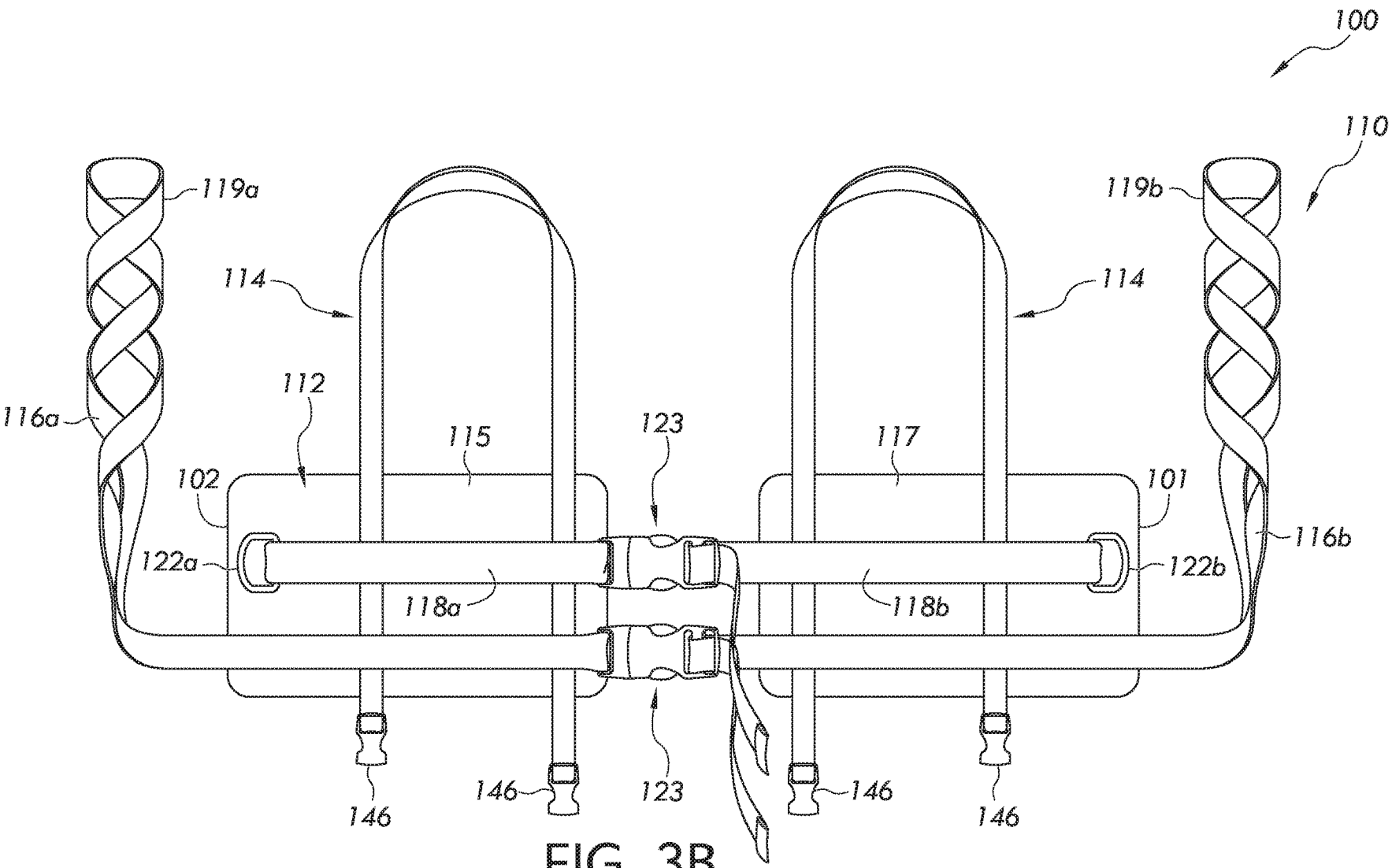
FIG. 3B schematically depicts a front view of an alternative upper portion of a subject support apparatus according to one or more embodiments shown and described herein.

It is contemplated that in other embodiments, the lower portion 130 may be removable from the upper portion 110. For example, the lower portion 130 may be coupled to the pair of shoulder straps using buckles 146 to releasably secure the upper portion 110 of the subject support apparatus 100 to the lower portion 130 of the subject support apparatus 100. In various embodiments, each buckle 146 may include a buckle and clip fastener, as depicted in FIGS. 3A and 3B. However, in other embodiments, the buckles 146 can include other types of fastening mechanism, such as ladder lock buckles, hooks and loops (e.g. VELCRO®), snaps, buttons, zippers, straps and rings, or any other suitable fastening mechanism for joining two discrete portions of strapping and/or material.

The buckles 146 of various embodiments may include adjustable buckles so as to enable the buckles 146 and corresponding straps to be adapted for use on subjects of various sizes. In various embodiments, when the buckles 146 are engaged, the upper portion 110 and the lower portion 130 are secured about the subject 10 such that the upper portion 110 and the lower portion 130 generally conform to the subject 10. For example, in some embodiments, when positioned on the subject 10, the upper portion 110 of the subject support apparatus 100 may be positioned above a center of mass 14 of the subject 10 and the lower portion 130 of the subject support apparatus 100 is positioned below the center of mass 14 of the subject 10. As used herein, the center of mass 14 of a subject generally corresponds to the lower abdominal area of the subject 10. Accordingly, when positioned on the subject 10, the upper portion 110 of the subject support apparatus 100 may be positioned above the abdominal area of the subject 10 and the lower portion 130 of the subject support apparatus 100 may be positioned below the abdominal area of the subject 10. Additionally, the upper portion 110 generally encircles the torso of the subject 10 while the lower portion 130 passes through the legs of the subject 10. In various embodiments, the torso panel 112 and the seat piece 150 are generally in continuous contact with the body of the subject 10 when the upper portion 110 and the lower portion 130 are secured about the subject 10 to maintain the subject 10 in position with respect to the subject support apparatus 100 and provide support to the subject 10.

In the embodiment depicted in FIGS. 1 and 2, the subject support apparatus 100 is coupled to a sling bar 200 by looping the shoulder straps 114 and the loop straps 116 over hooks of the sling bar 200, as will be described in greater detail below. The subject support apparatus 100 is selectively coupled to the sling bar 200 such that the subject support apparatus 100 is removable from the sling bar 200, and different subject support apparatuses may be coupled to the sling bar 200.

The sling bar 200 is coupled to an overhead structure 12. In embodiments, the overhead structure 12 may include a ceiling, an overhead beam, a mobile lift, or the like. By coupling the subject support apparatus 100 to the overhead structure 12 through the sling bar 200, some or all of the bodyweight of the subject 10 may be supported by the overhead structure 12, which may assist the subject 10 in a variety of activities, including standing and walking. For example, in some configurations the sling bar 200 and the overhead structure 12 may be positioned over a treadmill, and the overhead structure 12 may support some or all of the bodyweight of the subject 10, thereby assisting the subject 10 in walking on the treadmill. Sling bars 200 as well as overhead structures 12 are described in greater detail below.

Having generally described the subject support apparatus 100, the upper portion 110 and lower portion 130 will now be described in greater detail.

Referring to FIGS. 3A and 3B, the upper portion 110 of the subject support apparatus 100 is shown in detail. In the embodiment shown in FIG. 3A, the shoulder straps 114 are coupled to the torso panel 112 and each of the shoulder straps 114 extends from the top edge 105 of the torso panel 112 such that each of the shoulder straps 114 form a loop extending from the top edge 105 of the torso panel 112. When the subject support apparatus 100 is positioned on the subject 10 (e.g., as depicted in FIGS. 1 and 2), the subject 10 may place his or her arms through the loops formed by the shoulder straps 114. The shoulder straps 114 may be formed from any suitable material to support the bodyweight of the subject 10 (FIG. 1), such as nylon, polyester, cotton, or a blend of materials. The shoulder straps 114 may be used to couple the subject support apparatus 100 to the sling bar 200 by looping each of the shoulder straps 114 over the corresponding hook on the sling bar 200, as shown in FIGS. 1 and 2. In various embodiments, the shoulder straps 114 may transfer the weight of the subject up from the lower portion 130 of the subject support apparatus 100 and through the upper portion 110 of the subject support apparatus 100 to the sling bar 200 and the overhead structure 12. Accordingly, the shoulder straps 114 can assist in transferring and dispersing the load over a greater area, thereby reducing discomfort that may be experienced by the subject.

The torso panel 112 may be formed from any suitable material, including but not limited to nylon, polyester, cotton, or blends thereof. In various embodiments, the material may be coated, such as with vinyl or polyurethane. Accordingly, in some embodiments, the torso panel 112 may be formed from a coated fabric. The coating may be used to strengthen the material, to make the material wipable such that the material may be readily cleaned and/or sanitized, or impart other desirable characteristics to the material of the torso panel 112. The torso panel 112 may be formed from one or more layers of material, and may optionally include a cushioning material between two or more layers of material to provide comfort to the subject 10.

As depicted in FIG. 3A, the torso panel 112 may further include reinforcing webbing 113. The webbing 113 may reinforce the torso panel 112 to strengthen the torso panel. For example, as shown in FIG. 3A, the webbing 113 extends along the length L of the upper portion 110 of the subject support apparatus 100. The webbing 113 may be positioned in any suitable manner. In various embodiments, such as the embodiment depicted in FIG. 3A, the webbing 113 extends along the top edge 105 of the torso panel 112. It is contemplated that the webbing 113 may be positioned in other areas of the torso panel 112, such as areas that support a large portion of the load or may otherwise benefit from reinforcement. The webbing 113 may be formed from any suitable material, such as woven nylon, polyester, cotton, or a blend of materials. In particular embodiments, the webbing 113 may be formed from a woven nylon strap, such as a strap formed from ballistic nylon.

Figure 5:
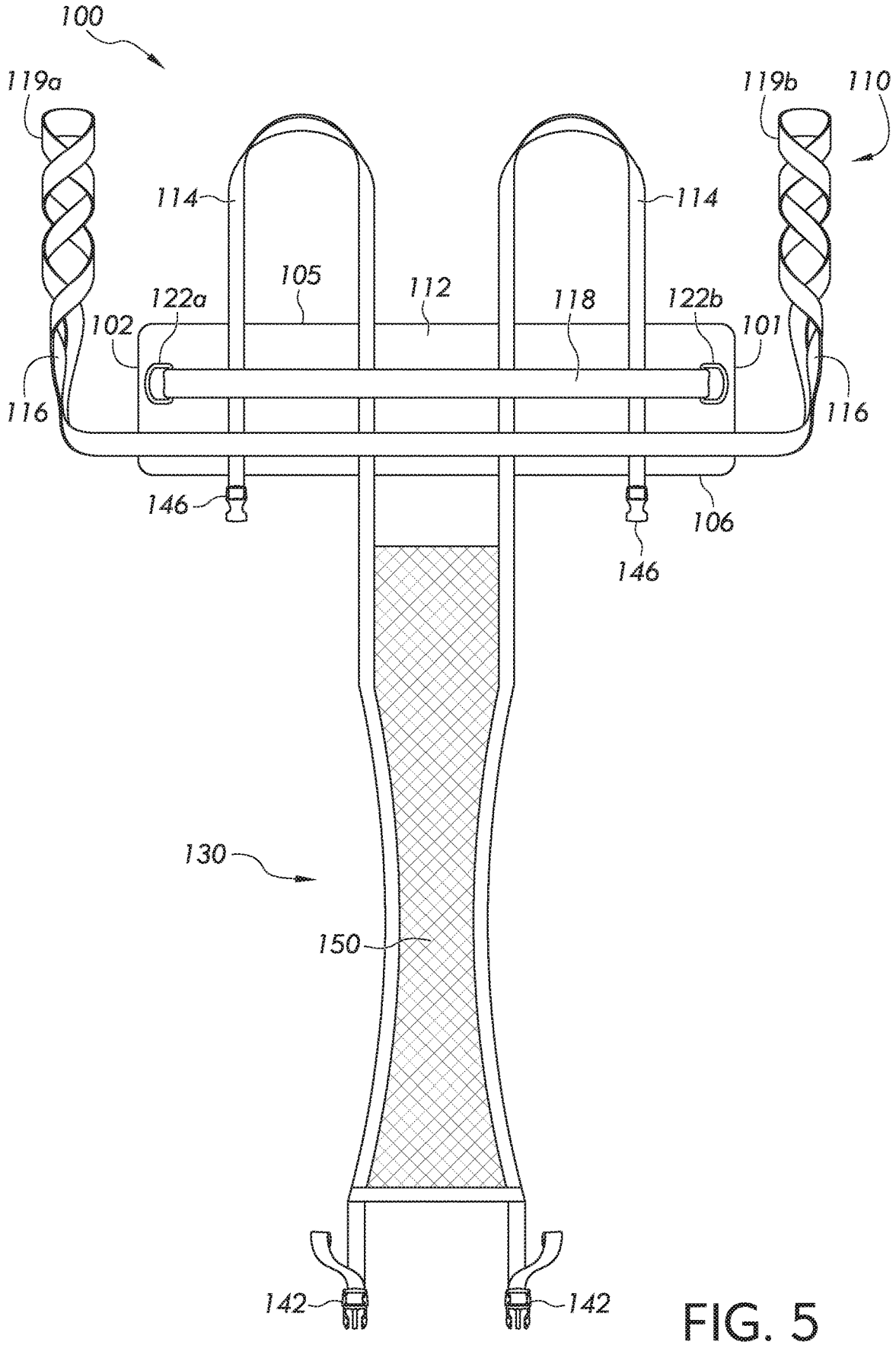
FIG. 5 schematically depicts a top view of the subject support apparatus of FIG. 1 according to one or more embodiments shown and described herein.

While embodiments are described and depicted herein as including webbing 113 across the torso panel 112, it should be understood that the webbing 113 is optional and that, in some embodiments, such as the embodiment depicted in FIG. 5, the upper portion 110 may be formed without webbing, such as when the torso panel 112 of the upper portion 110 is formed from a pliable material with sufficient tensile strength to support a subject during lifting without any further reinforcement.

The upper portion 110 further includes at least one loop strap 116 that is coupled to the torso panel 112 and extends from the first end 101 and the second end 102 of the torso panel 112. In the embodiment depicted in FIG. 3A, the loop strap 116 is coupled to the torso panel 112 and has a free ends 119*a*, 119*b* at each end of the torso panel 112. When the torso panel 112 is wrapped around the torso of the subject 10, each free end 119*a*, 119*b* of the loop strap 116 is passed through a ring 122*a*, 122*b* at each end of a central strap 118, which is also coupled to the torso panel 112. In embodiments, the free ends 119*a*, 119*b* of the loop strap 116 are crossed across the back of the subject 10. In other words, when the torso panel 112 is wrapped around the torso of the subject 10, free end 119*a* is passed through ring 122*b* and free end 119*b* is passed through ring 122*a* to adjustably secure the torso panel 112 around the torso of the subject 10, as depicted in FIG. 2.

Although the central strap 118 is depicted in FIG. 3A as including a ring 122*a*, 122*b* at each end, it is contemplated that the torso panel 112 may form a closed loop in other ways. For example, each end of the central strap 118 may form a loop, loops or rings may be disposed elsewhere on the torso panel 112, or the like. In still other embodiments, a buckle and clip fastener, ladder lock buckles, hooks and loops (e.g. VELCRO®), snaps, buttons, zippers, straps and rings, or any other suitable fastening mechanism for joining two discrete portions of strapping and/or material may be used to form a closed loop, such as to secure the torso panel 112 around the torso of the subject 10.

In various embodiments, each of the free ends 119*a*, 119*b* of the loop strap 116 may be used to couple the subject support apparatus 100 to the sling bar 200 in addition to coupling the subject support apparatus 100 to the sling bar 200 using the shoulder straps 114. For example, a loop of each of the free ends 119*a*, 119*b* may be looped over hooks of the sling bar 200, as shown in FIG. 2.

Although the embodiment depicted in FIG. 3A includes a single loop strap 116 that extends across the length L of the torso panel 112, in other embodiments, the upper portion 110 may include a pair of loop straps 116*a*, 116*b*, as depicted in FIG. 3B. The loop strap(s) 116 may be made of any suitable type of material, including, by way of example and not limitation, nylon, polyester, cotton, or a blend of materials. In embodiments, the loop strap(s) 116 may be formed from a woven nylon strap, such as a strap formed from ballistic nylon.

Referring to FIG. 3B, another embodiment of an upper portion 110 of the subject support apparatus 100 is schematically depicted. Similar to the embodiment depicted in FIG. 3A, the upper portion includes a torso panel 112 and shoulder straps 114. However, in the embodiment depicted in FIG. 3B, the torso panel 112 is in two parts. Specifically, in this embodiment the torso panel 112 includes a first portion 115 and a second portion 117. The torso panel 112 further includes two loop straps 116*a*, 116*b* that are coupled to one another and two central straps 118*a*, 118*b* that are coupled to one another.

The loop strap 116*a* and the central strap 118*a* are coupled to the corresponding loop strap 116*b* and central strap 118*b*, respectively, using buckles 123. In various embodiments, the buckles 123 may include a buckle and clip fastener, as depicted in FIG. 3B. However, in other embodiments, the buckles 123 may be replaced with another type of fastener, such as ladder lock buckles, hooks and loops (e.g. VELCRO®), snaps, buttons, zippers, straps and rings, or any other suitable fastening mechanism for joining two discrete portions of strapping and/or material. The buckles 123 of various embodiments are adjustable so as to enable the buckles 123 and corresponding straps to be adapted for use on subjects of various sizes. The buckle 123 used to couple the loop straps 116*a* to the corresponding loop strap 116*b* may be the same type of buckle 123 used to couple the central strap 118*a* to the corresponding central strap 118*b*, or the buckles 123 may be different types of fasteners. In other embodiments, a single fastener may be used to couple the first portion 115 and the second portion 117 of the torso panel 112 to each other. For example, the first portion 115 and the second portion 117 of the torso panel 112 may be coupled using a zipper or the like. In various embodiments, the buckles 123 enable the upper portion 110 to be secured around the torso of a subject from the front. Additionally or alternatively, the buckles 123 may enable adjustment of tension and pressure across the torso of the subject 10 applied by the upper portion 110 of the subject support apparatus 100.

In the embodiment depicted in FIG. 3B, when the torso panel 112 is wrapped around the torso of the subject 10, each free end 119*a*, 119*b* of the corresponding loop straps 116*a* and 116*b* is passed through a ring 122*a*, 122*b* at each end of the central straps 118*a* and 118*b*. In embodiments, the free ends 119*a*, 119*b* of the loop straps 116*a* and 116*b* are crossed across the back of the subject 10. In other words, when the torso panel 112 is wrapped around the torso of the subject 10, free end 119*a* is passed through ring 122*b* and free end 119*b* is passed through ring 122*a* to adjustably secure the torso panel 112 around the torso of the subject 10, as depicted in FIG. 2.

Figure 4:
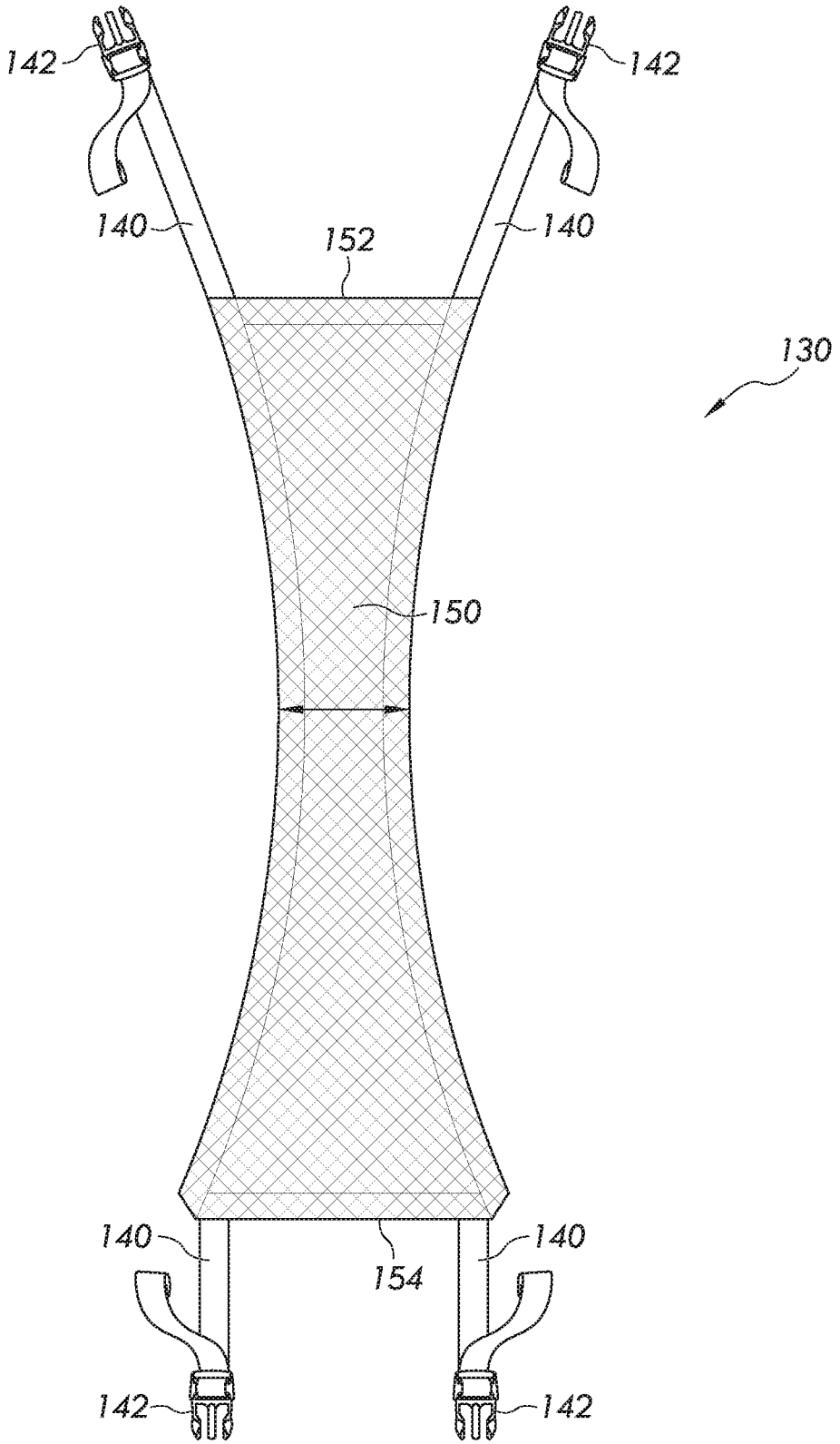
FIG. 4 schematically depicts a top view of a bottom portion of a subject support apparatus according to one or more embodiments shown and described herein.

Turning now to FIG. 4, a top view of the lower portion 130 of the subject support apparatus 100 is schematically depicted. The lower portion 130 includes a seat piece 150 having a rear end 152 and a front end 154. In embodiments, the seat piece 150 may be formed from a piece of flexible material which may be positioned between a subject's legs when the subject support apparatus 100 is positioned on a subject 10 as depicted in FIGS. 1 and 2. In some embodiments, the seat piece 150 may include padding, although in other embodiments, the seat piece 150 is free of padding or cushioning material. The seat piece 150 may be formed from any suitable material, such as woven nylon, polyester, cotton, or a blend of materials. In embodiments, the seat piece 150 may be formed of lambskin fleece and/or include a lining formed from lambskin fleece.

Still referring to FIG. 4, the lower portion 130 includes clips 142 for coupling the lower portion 130 to the corresponding buckles 146 of the upper portion 110 depicted in FIG. 3A or 3B. Each of the clips 142 is coupled to the lower seat piece 150 through a strap 140. The straps 140 may be, for example, sewn or otherwise affixed to the seat piece 150. In some embodiments, a strap 140 may extend from the rear end 152 of the seat piece 150, along the length of the seat piece 150, and from the front end 154. In other embodiments, the strap 140 may extend from the rear end 152 or from the front end 154 of the seat piece 150. Accordingly, two or more straps 140 may be employed to couple the clips 142 to the seat piece 150. In various embodiments, to couple the lower portion 130 to the upper portion 110 of the subject support apparatus 100, each clip 142 on the lower portion 130 is inserted into a corresponding buckle 144 on the upper portion 110.

Although various embodiments described herein contemplate the subject support apparatus 100 as including an upper portion 110 that is separable from the lower portion 130, in other embodiments, the upper portion 110 and the lower portion 130 are integral with one another, as depicted in FIGS. 1 and 5.

Referring now to FIG. 5, a subject support apparatus 100 including an upper portion 110 and a lower portion 130 is depicted. The upper portion 110 includes a torso panel 112, two shoulder straps 114, and a loop strap 116 for coupling a first end 101 of the torso panel 112 to a second end 102 of the torso panel to form a closed loop. Each shoulder strap 114 is coupled to the torso panel 112 and extends as a loop from the top edge 105 of the torso panel 112. As depicted in FIG. 5, one end of each shoulder strap 114 is coupled to a buckle 146 portion of a clip and buckle fastener and extends from the bottom edge 106 of the torso panel 112. It is contemplated that other types of fasteners may be employed, such as those described hereinabove. The other end of each shoulder strap 114 is non-releasably coupled to the lower portion 130 of the subject support apparatus 100 such as by stitching the end of the shoulder strap 114 to the seat piece 150.

To secure the subject support apparatus 100 around a subject 10, as shown in FIGS. 1 and 2, the arms of the subject 10 are inserted through the loops formed by the shoulder straps 114 and the torso panel 112 is placed across the torso of the subject. Each free end 119*a*, 119*b* of the loop strap 116 is passed through the ring 122*a*, 122*b* of the central strap 118 on the opposite side of the torso panel 112, crossing along the subject's back. More particularly, the free end 119*a* of the loop strap 116 is passed through the ring 122*b* near the first end 101 of the torso panel 112 and the free end 119*b* of the loop strap 116 is passed through the ring 122*a* near the second end 102 of the torso panel 112. The seat piece 150 is passed between the subject's legs and the clips 142 are inserted into the buckles 146 at the end of the shoulder straps 114. The shoulder straps 114 and the loop strap 116 may then be coupled to the sling bar 200 or other overhead structure by looping the straps over the hooks 606.

Sling Bars

Figure 6:
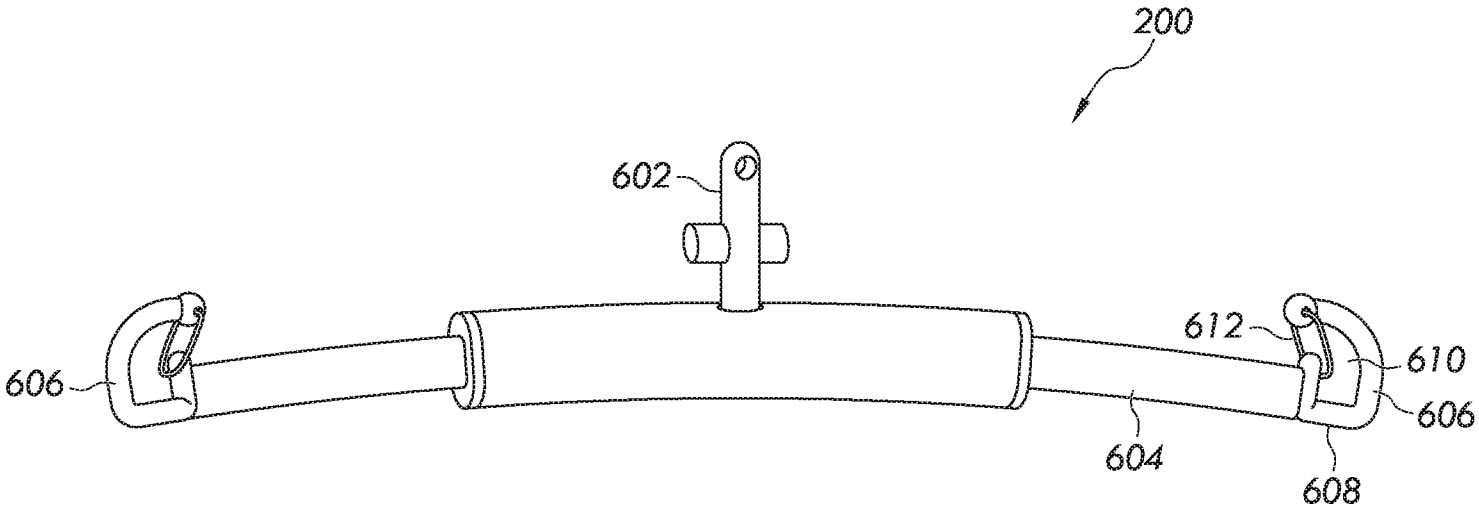
FIG. 6 schematically depicts a sling bar for use with the subject support apparatus according to one or more embodiments shown and described herein.

In various embodiments, such as the embodiment depicted in FIGS. 1 and 2, the subject support apparatus 100 is coupled to an overhead structure using a sling bar 200. FIG. 6 depicts a sling bar 200 in greater detail.

As shown in FIG. 6, the sling bar 200 includes a connector 602 for coupling the sling bar 200 to an overhead structure, such as a lift assembly. The connector 602 is fixedly coupled to the sling bar 200 in FIG. 6, although in other embodiments, the connector 602 may be movably coupled to the sling bar 200. Without being bound by theory, allowing the connector 602 to move with respect to the sling bar 200 may help to decrease the torque forces on the connector 602 when a subject support apparatus is coupled to the sling bar 200, maintain the alignment of the subject support apparatus, sling bar, and overhead structure, and prevent twisting of various components.

The sling bar 200 includes an elongated bar 604 and two hooks 606 coupled to the distal ends of the elongated bar 604. In other embodiments, the sling bar 200 may be an X-shaped sling bar that includes two curved frame members coupled by a middle frame member and including four support apparatus coupling mechanisms. In still other embodiments, the sling bar may include a U-shaped frame including two support apparatus coupling mechanisms and a U-shaped handle extending from the frame to provide stability to a subject being lifted. Other sling bar configurations are contemplated. Various sling bar configurations are described in greater detail in U.S. Patent Application Publication No. 2015/0216753, entitled "Person Lift System", which is hereby incorporated by reference in its entirety.

The hooks 606 include a coupling base 608 with a recessed space 610 therein and a latch 612 configured to selectively enclose the recessed space 610. The latch 612 is pivotally coupled to the coupling base 608 and is configured to extend across the recessed space 610 in a closed position and rotate towards the recessed space 610 in an open position. In operation, when a user couples a subject support apparatus 100 to the hook 606, the user pushes the latch 612 (i.e., rotates the latch 612 toward the recessed space 610), such as with the shoulder strap 114 and/or the loop strap 116 to allow the strap(s) or other portion of the subject support apparatus 100 to be inserted into the recessed space 610. When a user removes the subject support apparatus 100 from the hook 606, the user pushes the latch 612 to rotate the latch 612 toward an open position (i.e., rotates the latch 612 toward the recessed space 610) and allow the subject support apparatus 100 to be removed from the recessed space 610.

Suitable sling bars include, by way of example and not limitation, those commercially available under the trade names Universal SlingBar, SlingBar Mini, and Sling CrossBar, from Liko, HILL-ROM®, or Hill-Rom Services, Inc. (Batesville, Ind.). Additionally, it is contemplated that some embodiments may not include a sling bar, as will be described in greater detail below.

Overhead Structures

Figure 7:
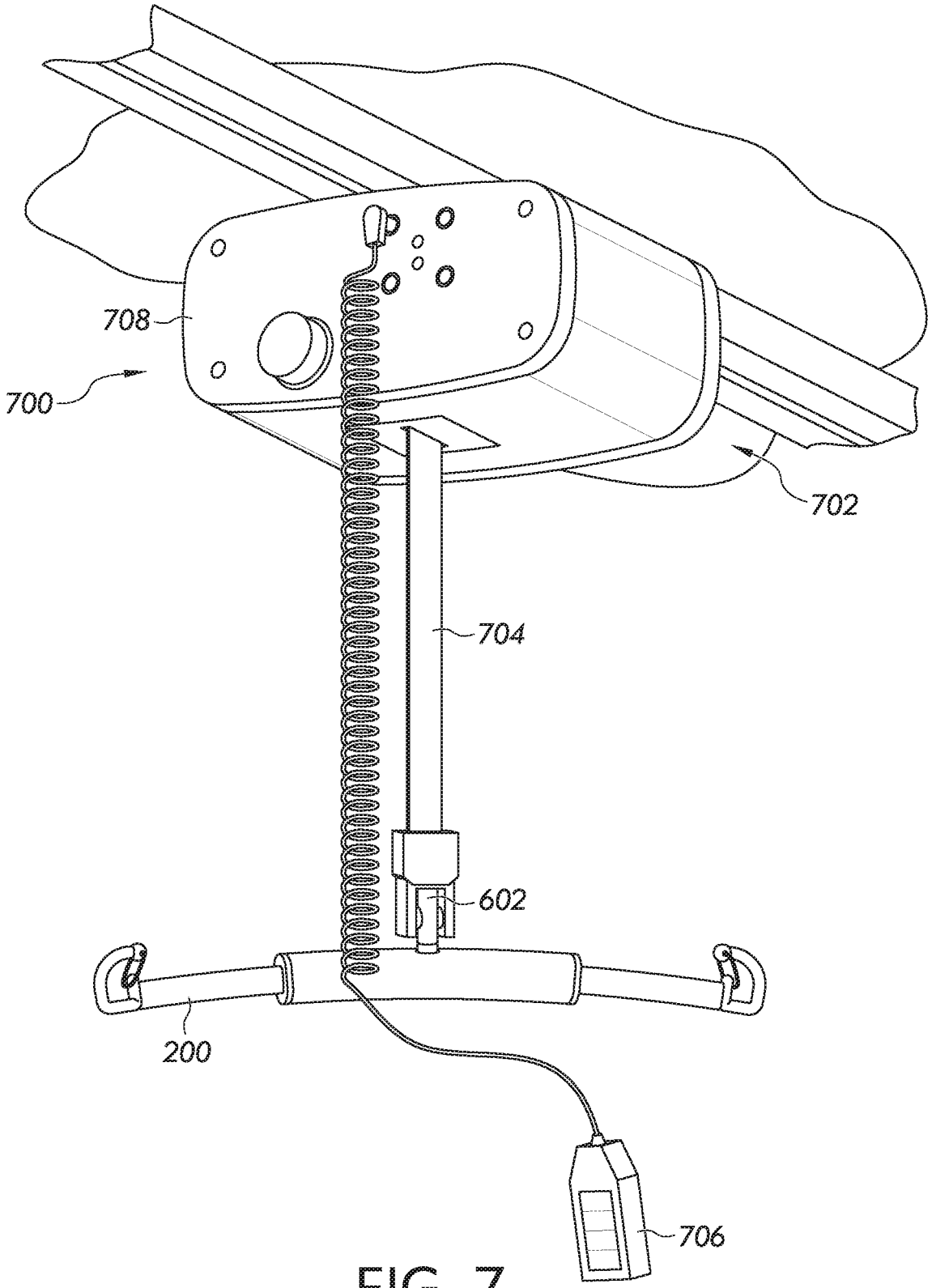
FIG. 7 schematically depicts a lift assembly for use with the subject support apparatus according to one or more embodiments shown and described herein.

In some embodiments, the overhead structure 12 may be a lift assembly, such as a mobile lift or, alternatively, an overhead lift assembly 700 as depicted in FIG. 7. The overhead lift assembly 700 may include a lift 702, a strap 704 configured to be extended and retracted by the lift 702, and a control system including an input device 706 configured to control operations of the lift 702. In embodiments, the sling bar 200 is coupled to an end of the strap 704 through the connector 602. The lift 702 may further include a motor and a drum (not shown), each positioned within a housing 708. The drum may be coupled to a shaft of the motor and may be configured to extend and retract the strap 704 as the motor rotates the drum in response to a user providing an input to the control system via an input device 706. Various lift assemblies may be employed, including those described in U.S. Patent Application Publication No. 2015/0216753, entitled "Person Lift System", which is hereby incorporated by reference in its entirety. Suitable commercially available lift assemblies include, by way of example and not limitation, lift systems available under the trade names GOLVO®, LIKO®, SABINA®, VIKING®, UNO™, LIKOGUARD™ LIKORALL™, and MULTI-RALL™, from Liko, HILL-ROM®, or Hill-Rom Services, Inc. (Batesville, Ind.).

While a lift assembly, such as the one shown and described in FIG. 7, may enable vertical lifting of the subject, in some embodiments, such as embodiments in which the subject is capable of standing or walking with support, the overhead structure 12 may provide support rather than vertical lifting. In such embodiments, the overhead structure 12 may be a ceiling. Alternatively or in addition, the overhead structure 12 may be another structure that is stationary in one or both vertical and horizontal directions relative to the ceiling. Without being bound by theory, embodiments in which the subject support apparatus 100 is coupled to a stationary overhead structure may enable facilities that cannot afford to have a complete overhead system including an overhead lift motor and a track, or otherwise lack such systems, to provide support to subjects that need it. Accordingly, coupling the subject support apparatus 100 may reduce budgetary concerns while enabling facilities to provide care to subjects that can support body weight.

Figure 8:
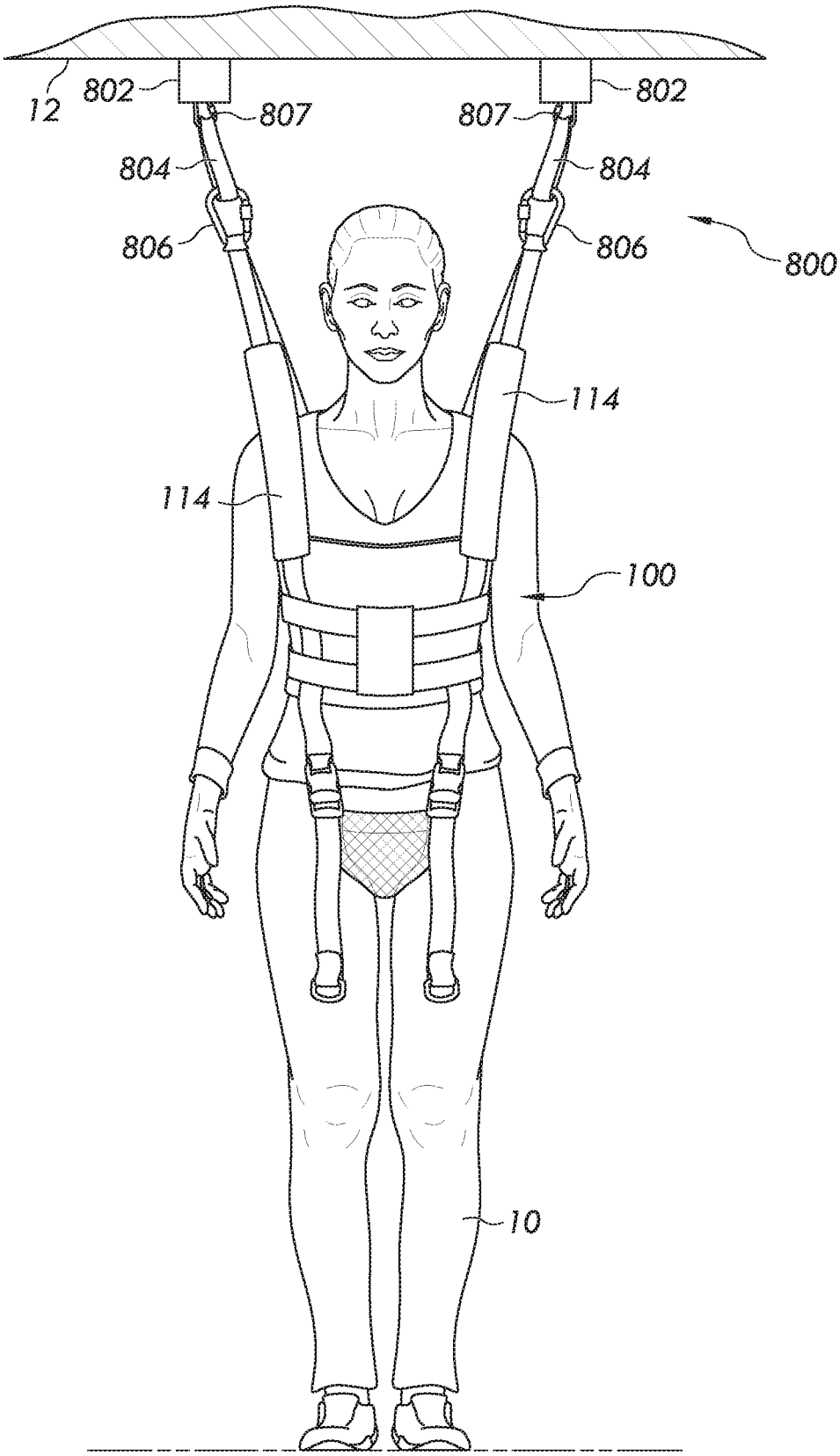
FIG. 8 schematically depicts a front view of a subject support apparatus coupled to an overhead structure according to one or more embodiments shown and described herein.

FIG. 8 depicts an embodiment in which the subject 10 is supported by an overhead structure 12 through the subject support apparatus 100. In embodiments, the overhead structure 12 may be a reinforced structure or other structure capable of supporting a substantial amount of weight, such as a concrete ceiling, a support beam, or the like.

In FIG. 8, the subject support apparatus 100 includes a support assist device 800 which couples the subject support apparatus 100 to the overhead structure 12 through a pair of mounting features 802. The mounting features 802 may be, by way of example and not limitation, bolts, hooks, or other secure mounting devices suitable for securing an object to the overhead structure 12. In various embodiments, the mounting features 802 are capable of supporting the weight of the subject without pulling out of the overhead structure 12. The mounting features 802 contemplated are not particularly limited, although in various embodiments, the mounting features 802 enable attachment of the subject support apparatus to a point that is stationary relative to a ceiling or overhead structure 12.

Figure 9:
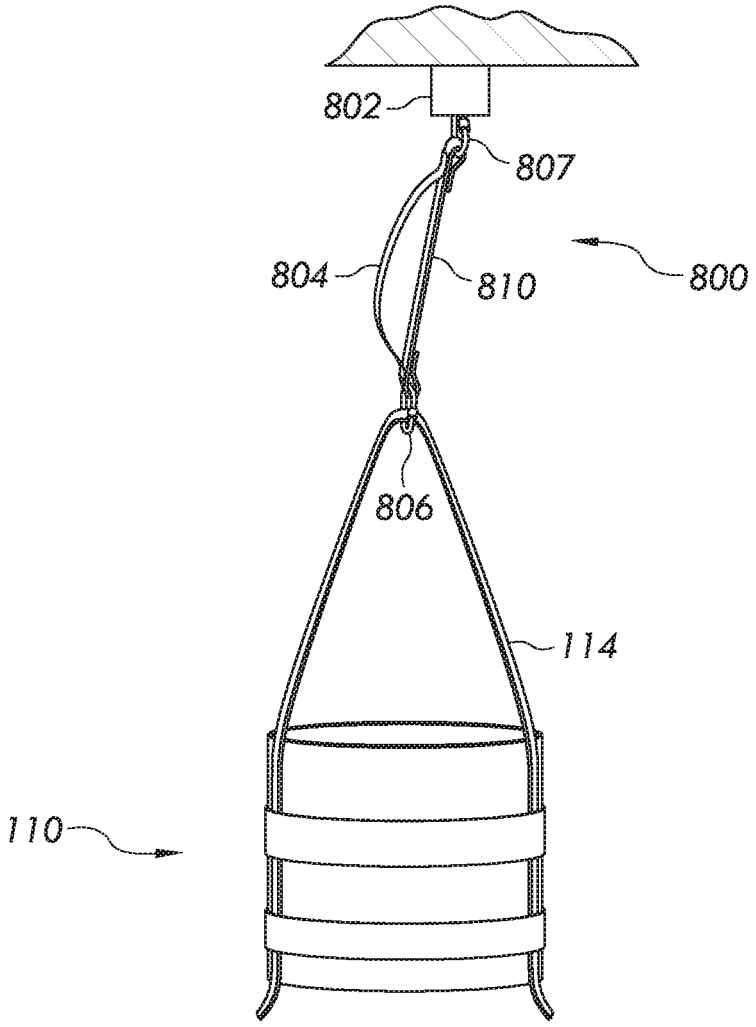
FIG. 9 schematically depicts a side view of the subject support apparatus coupled to the overhead structure of FIG. 8 according to one or more embodiments shown and described herein.

Referring to FIGS. 8 and 9, the support assist device 800 includes a limiting strap 804 and a first clip 806 for coupling the shoulder straps 114 of the subject support apparatus 100 to the limiting strap 804. The support assist device 800 further includes a second clip 807 for coupling the support assist device 800 to the mounting features 802. In various embodiments, the first clip 806 and the second clip 807 may be carabineer or a device similar to the hooks 606 described hereinabove. For example, the first clip 806 and/or the second clip 807 may each include a latch for securing the clip in a closed position. The first clip 806 and the second clip 807 may be the same type of coupling mechanism, or they may be different types of coupling mechanisms, depending on the particular embodiment.

The limiting strap 804 is connected at one end to the first clip 806 and at a second end to the second clip 807. The limiting strap 804 may be made of any suitable type of material, including but not limited to, nylon, polyester, and the like. In some embodiments, the limiting strap 804 may be made of ballistic nylon. Other materials may be used, provided that they are capable of supporting the weight of the subject without breaking. In embodiments, the limiting strap 804 is made of a substantially non-elastic material such that the strap does not elastically deform. The limiting strap 804 is adjustable in length, such as through an adjustment device or cinch, which enables the limiting strap 804 to be shortened or lengthened to a predetermined length to accommodate the particular subject. For example, the limiting strap 804 may be shortened for use with a taller subject, such as an adult man, and lengthened for use with a shorter subject, such as a child.

The support assist device 800 further includes at least one elastic strap 810, as depicted in the side view of the support assist device 800 in FIG. 9. Although an elastic strap 810 is described, a spring or other stretchable material may be used to provide the height adjustability of the support assist device 800. In various embodiments, a length of the limiting strap 804 is greater than a length of the elastic strap 810 when the elastic strap 810 is in a relaxed state. In practice, the elastic strap 810 may extend and retract to provide for certain height variations, such as when a subject supported by the support assist device 800 is walking, while the limiting strap 804 prevents the elastic strap 810 from being stretched beyond the length of the limiting strap 804, thereby preventing the subject from falling.

Similar to the limiting strap 804, the elastic strap 810 is coupled at one end to the first clip 806 and at the second end to the second clip 807. The elastic strap 810 may be formed of an elastic material, such as rubber, a synthetic material (e.g., an elastomer), or a combination thereof. Other suitable elastic materials may be employed, depending on the particular embodiment. In some embodiments, the elastic strap 810 may include one or more elastic strands forming a core covered in a woven cotton or polypropylene sheath. As an example and without limitation, in embodiments, the elastic strap 810 may be made of the same materials as a bungee cord.

In the embodiment depicted in FIG. 9, the limiting strap 804 and the elastic strap 810 are coupled to one another through the first clip 806 and the second clip 807. In other words, a first end of the limiting strap 804 is coupled to a first end of the elastic strap 810 and a second end of the limiting strap 804 is coupled to a second end of the elastic strap 810. However, in other embodiments, the limiting strap 804 and the elastic strap 810 may be coupled to one another in other ways, such as through one or more rings, stitches, or the like. In still other embodiments, the limiting strap 804 and the elastic strap 810 may be braided together or otherwise intertwined along at least a portion of their lengths.

Figure 10:
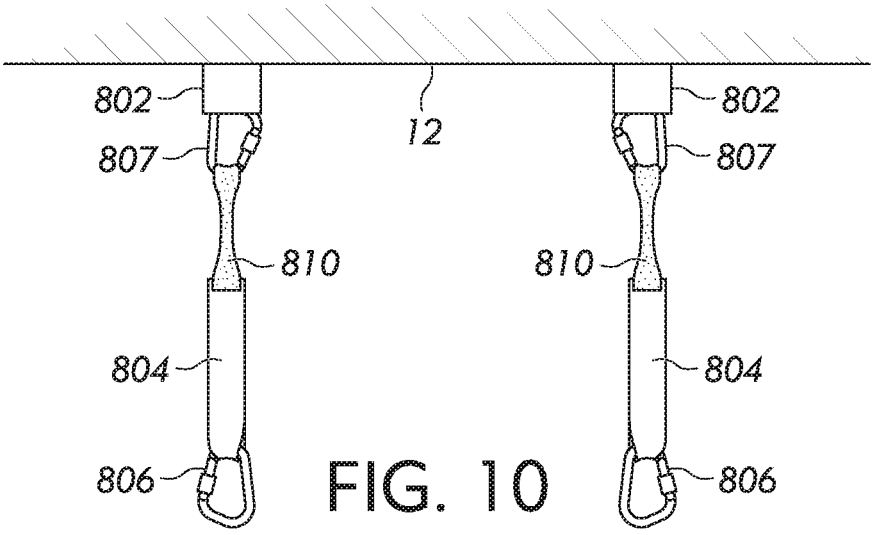
FIG. 10 schematically depicts an alternative support assist device for coupling a subject support apparatus to an overhead structure according to one or more embodiments shown and described herein.

In yet another embodiment, such as the embodiment depicted in FIG. 10, the limiting strap 804 and the elastic strap 810 are connected at one end. In particular, the limiting strap 804 is connected at one end to the first clip 806 and at a second end to a first end of the elastic strap 810. The limiting strap 804 and the elastic strap 810 may be coupled to one another in any one of a variety of ways, such as through one or more clips, rings, stitches, or the like.

The elastic strap 810 is connected at a second end to the second clip 807, for coupling to the mounting features 802. As above, the limiting strap 804 is adjustable, such as through an adjustment device which shortens or lengthens the limiting strap 804 (e.g., a cinch), which enables the limiting strap 804 to be shortened or lengthened to accommodate the particular subject. For example, the limiting strap 804 may be shortened for use with a taller subject, such as an adult man, and lengthened for use with a shorter subject, such as a child. The elastic strap 810 may provide for height variations, such as when a subject supported by the support assist device 800 is walking, while providing sufficient resistance to prevent the subject from falling.

In still other embodiments, the limiting strap 804 has a first end connected to the elastic strap 810 and a second end connected to the second clip 807 while the second end of the elastic strap 810 is connected to the first clip 806. Accordingly, it is contemplated that when the limiting strap 804 and the elastic strap 810 are connected end to end, either strap may be connected to the first clip 806 and either strap may be connected to the second clip 807. In other words, either the limiting strap 804 or the elastic strap 810 may be positioned closer to the overhead structure 12 while the other is positioned closer to the subject 10.

In practice, the subject support apparatus 100 is secured about the subject 10, as described hereinabove. Each of the shoulder straps 114 of the subject support apparatus 100 is coupled to the first clip 806 of a corresponding support assist device 800. The subject 10 moves to a position beneath the mounting features 802 that are coupled to the overhead structure 12. For example, the subject 10 may move beneath the mounting features 802 by walking with assistance from a caregiver. Each of the support assist devices 800 are coupled to the mounting features 802, such as through the second clip 807. The limiting strap 804 is adjusted such that when the subject 10 is in a standing position, the limiting strap 804 is not fully extended. The subject 10 may then participate in a therapy activity, such as walking on a treadmill positioned beneath the mounting features 802. As the subject 10 moves, the elastic strap 810 provides support and extends and contracts to account for vertical changes resulting from the subject's gait. In the event that the subject stumbles and/or begins to fall, the elastic strap 810 will extend until the limiting strap 804 is fully extended. Thus, the limiting strap 804 prevents the elastic strap 810 from over-extending and allowing the subject to fall.

As an alternative to the support assist device 800 being removably coupled to the subject support apparatus 100, in some embodiments, the support assist device 800 may be integral with the subject support apparatus 100. For example, the pair of shoulder straps 114 may perform the function of the limiting strap 804 while the loop strap 116 may perform the function of the elastic strap 810.

In such embodiments, the pair of shoulder straps 114 may be made of any suitable type of material, including but not limited to, nylon, polyester, and the like. In some embodiments, the pair of shoulder straps 114 may be made of ballistic nylon. Other materials may be used, provided that they are capable of supporting the weight of the subject without breaking. The pair of shoulder straps 114 may be adjustable, such as through a cinch, which enables the pair of shoulder straps 114 to be shortened or lengthened to accommodate the particular subject.

The loop strap 116 may include at least a portion that is made of an elastic material, such as rubber, a synthetic material (e.g., an elastomer), or a combination thereof. Other suitable elastic materials may be employed, depending on the particular embodiment. In embodiments, the loop strap 116 may be made entirely out of the elastic material, or the loop strap 116 may be made of an elastic material coupled to another type of material, such as nylon or polyester. For example, in some embodiments, the loop strap 116 includes a first portion made of nylon or polyester and a second portion made of an elastic material. The elastic material may be located near the torso panel, near the free ends 119*a*, 119*b* of the loop strap 116, or at any other point over the length of the loop strap. In embodiments, the elastic material enables the loop strap to lengthen and contract to enable a subject supported by the subject support apparatus 100 to move horizontally and vertically (such as when walking) while the subject support apparatus 100 is coupled to an overhead structure 12, including a lift device, a ceiling, an overhead beam, or the like.

Although an embodiment in which the shoulder straps 114 perform the function of the limiting strap 804 and the loop strap 116 performs the function of the elastic strap 810, it is further contemplated that the shoulder straps 114 may perform the function of the elastic strap 810 and the loop strap 116 may perform the function of the limiting strap 804.

Based on the foregoing, it should be understood that various embodiments provide for subject support apparatuses that include an upper portion and a lower portion coupled together through shoulder straps that transfer the load of the subject up from the lower portion and through the upper portion of the subject support apparatus. Such embodiments may provide additional comfort and support to subjects as compared to conventional subject support apparatuses. Moreover, various embodiments described herein provide subject support apparatuses that include support assist devices that can be used to couple subject support apparatuses to one or more support structures, including stationary support structures. Such support assist devices may enable facilities that lack mechanical lift devices to nonetheless provide support to subjects, such as those undergoing physical therapy or rehabilitation.

Embodiments can be described with reference to the following numbered clauses, with preferred features laid out in the dependent clauses:

1. A subject support apparatus comprising an upper portion and a lower portion. The upper portion comprises a torso panel having a first end and a second end; a loop strap having a first free end extending from the first end of the torso panel and a second free end extending from the second end of the torso panel and configured to couple the first end of the torso panel to the second end of the torso panel to form a closed loop; and a pair of shoulder straps coupled to the torso panel and extending from a top edge of the torso panel. The lower portion is coupled to the pair of shoulder straps and extends from a bottom edge of the torso panel. The lower portion comprises a seat piece having a front end and a rear end.

2. The subject support apparatus of the preceding clause, wherein the upper portion further comprises a central strap coupled to the torso panel, wherein the central strap extends from the first end of the torso panel to the second end of the torso panel.

3. The subject support apparatus of clause 2, wherein the pair of shoulder straps are coupled to the central strap.

4. The subject support apparatus of any preceding clause, wherein the lower portion is removable from the upper portion of the subject support apparatus.

5. The subject support apparatus of any preceding clause, wherein the lower portion is releasably secured to the pair of shoulder straps through buckles.

6. The subject support apparatus of any preceding clause, wherein the torso panel comprises a first portion and a second portion coupled together using at least one buckle.

7. The subject support apparatus of any preceding clause, wherein an end of each of the pair of shoulder straps is non-releasably coupled to the lower portion of the subject support apparatus.

8. The subject support apparatus of any preceding clause, wherein the end of each of the pair of shoulder straps is stitched to the seat piece to couple the lower portion to the pair of shoulder straps.

9. The subject support apparatus of any preceding clause, wherein at least a portion of one of the loop strap and the pair of shoulder straps comprises an elastic material.

10. The subject support apparatus of any preceding clause, wherein the loop strap comprises a first portion comprising the elastic material and a second portion comprising nylon or polyester.

11. The subject support apparatus of any preceding clause, wherein the pair of shoulder straps are adjustable in length.

12. A subject support system comprising a subject support apparatus of any preceding clause, and a support assist device comprising at least one elastic strap coupled to at least one limiting strap; wherein the support assist device is coupled to the pair of shoulder straps of the subject support apparatus and is configured to couple the subject support system to an overhead structure.

13. The subject support system of clause 12, wherein the limiting strap has a length that is greater than a length of the elastic strap when the elastic strap is in a relaxed state.

14. The subject support system of clause 12 or 13, wherein the overhead structure is stationary in at least a horizontal direction.

15. The subject support system of any of clauses 12-14, wherein the overhead structure is stationary in at least a vertical direction.

16. The subject support system of any of clauses 12-15, wherein the overhead structure is a ceiling.

17. The subject support system of any of clauses 12-16, wherein a first end of the elastic strap is coupled to a first end of the limiting strap through a first clip and a second end of the elastic strap is coupled to a second end of the limiting strap through a second clip.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A subject support apparatus comprising:

an upper portion comprising:

a torso panel having a first end and a second end;

a central strap coupled to the torso panel, the central strap extending from the first end of the torso panel to the second end of the torso panel;

a loop strap having a first free end extending from the first end of the torso panel and a second free end extending from the second end of the torso panel and configured to couple the first end of the torso panel to the second end of the torso panel to form a closed loop, wherein the first free end of the loop strap engages the central strap at the second end of the torso panel and the second free end of the loop strap engages the central strap at the first end of the torso panel; and a pair of shoulder straps coupled to the torso panel and extending from a top edge of the torso panel; and a lower portion coupled to the pair of shoulder straps and extending from a bottom edge of the torso panel, the lower portion comprising a seat piece having a front end and a rear end.

2. The subject support apparatus of claim 1, wherein the pair of shoulder straps are coupled to the central strap.

3. The subject support apparatus of claim 1, wherein the lower portion is removable from the upper portion of the subject support apparatus.

4. The subject support apparatus of claim 3, wherein the lower portion is releasably secured to the pair of shoulder straps through buckles.

5. The subject support apparatus of claim 3, wherein the torso panel comprises a first portion and a second portion coupled together with at least one buckle.

6. The subject support apparatus of claim 1, wherein an end of each of the pair of shoulder straps is non-releasably coupled to the lower portion of the subject support apparatus.

7. The subject support apparatus of claim 6, wherein the end of each of the pair of shoulder straps is stitched to the seat piece to couple the lower portion to the pair of shoulder straps.

8. A subject support apparatus comprising:

an upper portion comprising:

a torso panel having a first end and a second end;

a central strap coupled to the torso panel, the central strap extending from the first end of the torso panel to the second end of the torso panel;

a loop strap having a first free end extending from the first end of the torso panel and a second free end extending from the second end of the torso panel and configured to couple the first end of the torso panel to the second end of the torso panel to form a closed loop, wherein the first free end of the loop strap engages the central strap at the second end of the torso panel and the second free end of the loop strap engages the central strap at the first end of the torso panel; and a pair of shoulder straps coupled to the torso panel and extending from a top edge of the torso panel; and a lower portion coupled to the pair of shoulder straps and extending from a bottom edge of the torso panel, the lower portion comprising a seat piece having a front end and a rear end;

wherein at least a portion of one of the loop strap and the pair of shoulder straps comprises an elastic material.

9. The subject support apparatus of claim 8, wherein the loop strap comprises a first portion comprising the elastic material and a second portion comprising nylon or polyester.

10. The subject support apparatus of claim 9, wherein the pair of shoulder straps are adjustable in length.

11. The subject support apparatus of claim 8, wherein an end of each of the pair of shoulder straps is non-releasably coupled to the lower portion of the subject support apparatus.

12. A subject support system comprising:

a subject support apparatus comprising:

an upper portion comprising:

a torso panel having a first end and a second end;

a central strap coupled to the torso panel, the central strap extending from the first end of the torso panel to the second end of the torso panel;

a loop strap having a first free end extending from the first end of the torso panel and a second free end extending from the second end of the torso panel and configured to couple the first end of the torso panel to the second end of the torso panel to form a closed loop, wherein the first free end of the loop strap engages the central strap at the second end of the torso panel and the second free end of the loop strap engages the central strap at the first end of the torso panel; and a pair of shoulder straps coupled to the torso panel and extending from a top edge of the torso panel; and a lower portion coupled to the pair of shoulder straps and extending from a bottom edge of the torso panel, the lower portion comprising a seat piece having a front end and a rear end; and a support assist device comprising at least one elastic strap coupled to at least one limiting strap;

wherein the support assist device is coupled to the pair of shoulder straps of the subject support apparatus and is configured to couple the subject support system to an overhead structure.

13. The subject support system of claim 12, wherein the at least one limiting strap has a length that is greater than a length of the at least one elastic strap when the at least one elastic strap is in a relaxed state.

14. The subject support system of claim 12, wherein the lower portion is removable from the upper portion of the subject support apparatus.

15. The subject support system of claim 12, wherein the overhead structure is stationary in at least a horizontal direction.

16. The subject support system of claim 12, wherein the overhead structure is stationary in at least a vertical direction.

17. The subject support system of claim 12, wherein the overhead structure is a ceiling.

18. The subject support system of claim 12, wherein a first end of the at least one elastic strap is coupled to a first end of the at least one limiting strap through a first clip and a second end of the at least one elastic strap is coupled to a second end of the at least one limiting strap through a second clip.

19. The subject support apparatus of claim 12, wherein an end of each of the pair of shoulder straps is non-releasably coupled to the lower portion of the subject support apparatus.

* * * * *